US007257364B2

(12) United States Patent
Ishikawa

(10) Patent No.: US 7,257,364 B2
(45) Date of Patent: Aug. 14, 2007

(54) PAPER FEEDING MECHANISM FOR CONTINUOUS FORM PRINTER

(75) Inventor: Yutaka Ishikawa, Tokyo (JP)

(73) Assignee: PENTAX Corporation, Tokyo (JP)

( * ) Notice: Subject to any disclaimer, the term of this patent is extended or adjusted under 35 U.S.C. 154(b) by 82 days.

(21) Appl. No.: 11/008,241

(22) Filed: Dec. 10, 2004

(65) Prior Publication Data

US 2005/0129437 A1 Jun. 16, 2005

(30) Foreign Application Priority Data

Dec. 12, 2003 (JP) ..... 2003-414603

(51) Int. Cl.
*G03G 15/00* (2006.01)

(52) U.S. Cl. ..... 399/387; 399/384

(58) Field of Classification Search ..... 399/384, 399/387, 361, 331, 330, 329, 322
See application file for complete search history.

(56) References Cited

U.S. PATENT DOCUMENTS 3,648,431 A * 3/1972 Hartbauer et al. ..... 53/528
4,105,386 A * 8/1978 Thiel et al. ..... 425/217
4,912,490 A * 3/1990 Negoro et al. ..... 347/139
4,919,047 A * 4/1990 Inouye et al. ..... 101/175
5,255,008 A 10/1993 Yoshida ..... 346/24
RE34,685 E 8/1994 Negishi et al. ..... 399/322
5,493,377 A 2/1996 Nishikawa et al. ..... 399/328
5,549,401 A 8/1996 Ishikawa et al. ..... 400/618
6,175,715 B1 * 1/2001 Hirao et al. ..... 399/384
6,674,979 B2 * 1/2004 Nagano ..... 399/68

FOREIGN PATENT DOCUMENTS

JP 7-146625 6/1995

* cited by examiner

*Primary Examiner*—Anthony H. Nguyen
(74) *Attorney, Agent, or Firm*—Greenblum & Bernstein, P.L.C.

(57) ABSTRACT

A paper feeding mechanism for a printer includes a discharging unit located on a downstream side of a paper feed path, a feeding unit located on an upstream side with respect to the image transfer station, a tension applying unit that operates to apply tension to the continuous form paper at a position between the image transfer station and the discharging unit. Further provided is a displacement preventing system that prevents a displacement of the continuous form paper in a feeding direction of the continuous form paper when the tension applying unit operates to apply the tension to the continuous form paper.

18 Claims, 4 Drawing Sheets

PAPER FEEDING MECHANISM FOR CONTINUOUS FORM PRINTER

BACKGROUND OF THE INVENTION

The present invention relates to a paper feeding mechanism for a continuous form printer that prints out information on continuous form paper.

Conventionally, continuous form printers which print out images in accordance with a so-called electrophotographic imaging method have been known.

According to the method, photoconductive material provided on a circumferential surface of a photoconductive drum of the printer is exposed to light which is modulated in accordance with image data, thereby a latent image being formed thereon. Then, toner is applied to the drum to form a toner image thereon (i.e., the latent image is developed). The toner image thus developed is transferred onto the paper, and the transferred toner image is fixed on the paper by a fixing device. Among such printers, one using continuous form recording paper has been known and widely used. An example of such a printer is disclosed in Japanese Patent Publication No. HEI 07-146625.

Typically, the continuous form paper is used in the form of fanfold paper, which is foldable continuous paper provided with sprocket holes on both end portions in its width direction of the paper.

As shown in the publication, in the printer using the fanfold paper, a tractor unit is provided to feed the paper. The tractor unit is provided with pins on a pair of belts located facing the end portions, in the width direction, of the paper. The belts are driven to move thereby the pins engaging with the sprocket holes of the paper pushing the paper to feed the same.

The tractor unit is provided on upstream side of a transfer unit where the toner image is transferred to the paper. In order to maintain tension of the paper during the imaging process within a certain range, a mechanism that applies the tension to the paper is generally provided on downstream side of a fixing unit, where the toner image is fixed. Typically, a pair of discharge rollers that function to discharge the paper out of the printer, and a tension plate that applies tension to the paper is provided between the tractor unit and the discharge rollers.

Some continuous form printers are configured such that an image is printed on a first page of the continuous form printer. That is, a toner image is transferred on the recording paper when a leading end of the continuous form paper is being fed from the tractor unit to the discharge rollers. In such a case, the continuous paper is firstly fed by the tractor unit. That is, each of the pins of the tractor unit pushes the upstream side edge of the corresponding sprocket hole. This state continues until the leading end of the paper is engaged with the rollers located on the upstream side and appropriate tension is applied to the paper.

When the leading end portion is engaged with the rollers on the upstream side, the tension plate is driven to push the paper to apply the tension thereto. At this stage, the paper is slightly pulled to move toward the portion where the tension plate contact the paper.

Since each pin of the tractor unit contacts the upstream side edge of the sprocket hole and the paper is pulled to move on the upstream side, the paper moves relative to the tractor unit toward the upstream side. Since the toner image is being transferred at this stage, the transferred image is deteriorated due to the shift of the paper.

SUMMARY OF THE INVENTION

The present invention is advantageous in that the shift of the continuous form paper during the image transferring process is prevented.

According to an aspect of the invention, there is provided a paper feeding mechanism for a printer in which an image is transferred, at an image transfer station, onto continuous form paper which is fed along a paper feed path defined in the printer. The paper feeding mechanism includes a discharging unit located on a downstream side of the paper feed path, the discharging unit feeding the continuous form paper to discharge from the printer, a feeding unit located on an upstream side with respect to the image transfer station, the feeding unit feeding the continuous form paper toward the image transfer station, a tension applying unit that operates to apply tension to the continuous form paper at a position between the image transfer station and the discharging unit, and a displacement preventing system that prevents a displacement of the continuous form paper in a feeding direction of the continuous form paper when the tension applying unit operates to apply the tension to the continuous form paper.

Optionally, the paper feeding mechanism may further include an outlet side paper sensor arranged in the vicinity of the discharging unit, the outlet side paper sensor detecting whether the continuous form paper is present at a position of the outlet side paper sensor. The tension applying unit may be activated after the outlet side paper sensor detects that the continuous form paper is present.

In this case, the displacement preventing system may be deactivated after the tension applying unit applies the tension to the continuous form paper.

Further optionally, the displacement preventing system may be configured to feed the continuous form paper at a speed faster than the feeding speed of the feeding unit.

Still optionally, the displacement preventing system may be located at a position between the feeding unit and the tension applying unit.

Further, the displacement preventing system may include a pair of rollers, and a driving system that drives the pair of rollers to rotate.

In a particular case, the pair of rollers may include a driving roller that is actuated to rotate and a driven roller that is freely rotatably supported, and a circumferential surface of the driving roller may have a higher frictional coefficient than that of the driven roller.

Optionally, the paper feeding mechanism may further include an inlet side paper sensor located on an upstream side of the displacement preventing system, the inlet side paper sensor detecting whether the paper is present at a position where the inlet side paper sensor is located, the displacement preventing system being activated when the inlet side paper sensor detects presence of the continuous form paper.

In such a case, the image transfer may be allowed after the displacement preventing system is activated.

Additionally, the mechanism may include an outlet side paper sensor arranged in the vicinity of the discharging unit, the outlet side paper sensor detecting whether the continuous form paper is present at a position of the outlet side paper sensor, the displacement preventing system being deactivated at a predetermined period after the outlet side paper sensor detects the presence of the continuous form paper.

Still optionally, the paper feeding mechanism may further include a trailing end sensor that detects the trailing end of the continuous form paper, the trailing end sensor being arranged on an upstream side of the feeding unit, the displacement preventing system being activated when the trailing end sensor detects the trailing end of the continuous form paper.

In this case, the paper feeding mechanism may further include an outlet side paper sensor arranged in the vicinity of the discharging unit, the outlet side paper sensor detecting whether the continuous form paper is present at a position of the outlet side paper sensor, the displacement preventing system being deactivated when the outlet side paper sensor detects absence of the continuous form paper after the trailing end sensor detects the trailing end of the continuous form paper.

Further optionally, the feeding unit may include a tractor unit having a pair of tractor belts each provided with a plurality of tractor pins, the continuous form paper being formed with a plurality of sprocket holes with which the plurality of tractor pins engage, respectively.

In particular, each sprocket hole may be elongated in the feeding direction of the continuous form paper, a clearance being formed between a surface of each tractor pin and an upstream side edge of a corresponding sprocket hole when the continuous form paper is fed by the feeding unit and the displacement preventing system is deactivated, a clearance being formed between the surface of each tractor pin and a downstream side edge of a corresponding sprocket hole when the continuous form paper is fed by the displacement preventing system.

According to another aspect of the invention, there is provided an electrophotographic printer that forms an image on continuous form paper in accordance with an electrophotographic imaging method, the printer including a scanning unit that emits a scanning beam which is modulated in accordance with print information, a photoconductive drum which is exposed to the scanning beam, a latent image being formed on the photoconductive drum as scanned by the scanning beam, a developing unit that develops the latent image by applying toner to the latent image to form a toner image, a transfer unit that transfers the toner image on the continuous form paper which is fed along a paper feed path defined in the printer, a fixing unit that fixes the toner image transferred onto the continuous form paper, a discharging unit located on a downstream side of the paper feed path, the discharging unit feeding the continuous form paper to discharge from the printer, a feeding unit located on an upstream side with respect to the transfer unit, the feeding unit feeding the continuous form paper toward the transfer unit, a tension applying unit that operates to apply tension to the continuous form paper at a position between the transfer unit and the discharging unit, and a displacement preventing system that prevents a displacement of the continuous form paper in a feeding direction of the continuous form paper when the tension applying unit operates to apply the tension to the continuous form paper.

According to a further aspect of the invention, there is provided a method of feeding continuous form paper in a printer in which an image is transferred, at an image transfer station, onto continuous form paper which is fed along a paper feed path defined in the printer, the printer including a discharging unit located on a downstream side of the paper feed path, the discharging unit feeding the continuous form paper to discharge from the printer, a feeding unit located on an upstream side with respect to the image transfer station, the feeding unit feeding the continuous form paper toward the image transfer station, a tension applying unit that operates to apply tension to the continuous form paper at a position between the image transfer station and the discharging unit, an auxiliary feeding unit located between the feeding unit and the transfer station. The method may include detecting a leading end of the continuous form paper at a position on the upstream side of the auxiliary feeding unit, activating the auxiliary feeding unit to feed the continuous paper at a speed higher than the feeding speed of the feeding unit, allowing the image transfer onto the continuous form paper, detecting the leading end of the continuous form paper at a position in the vicinity of the discharging unit, activating the tension applying unit to apply tension to the continuous form paper, and deactivating the auxiliary feeding unit after the tension applying unit has been activated to apply the tension to the continuous form paper.

BRIEF DESCRIPTION OF THE ACCOMPANYING DRAWINGS

DESCRIPTION OF THE EMBODIMENTS

Figure 1:
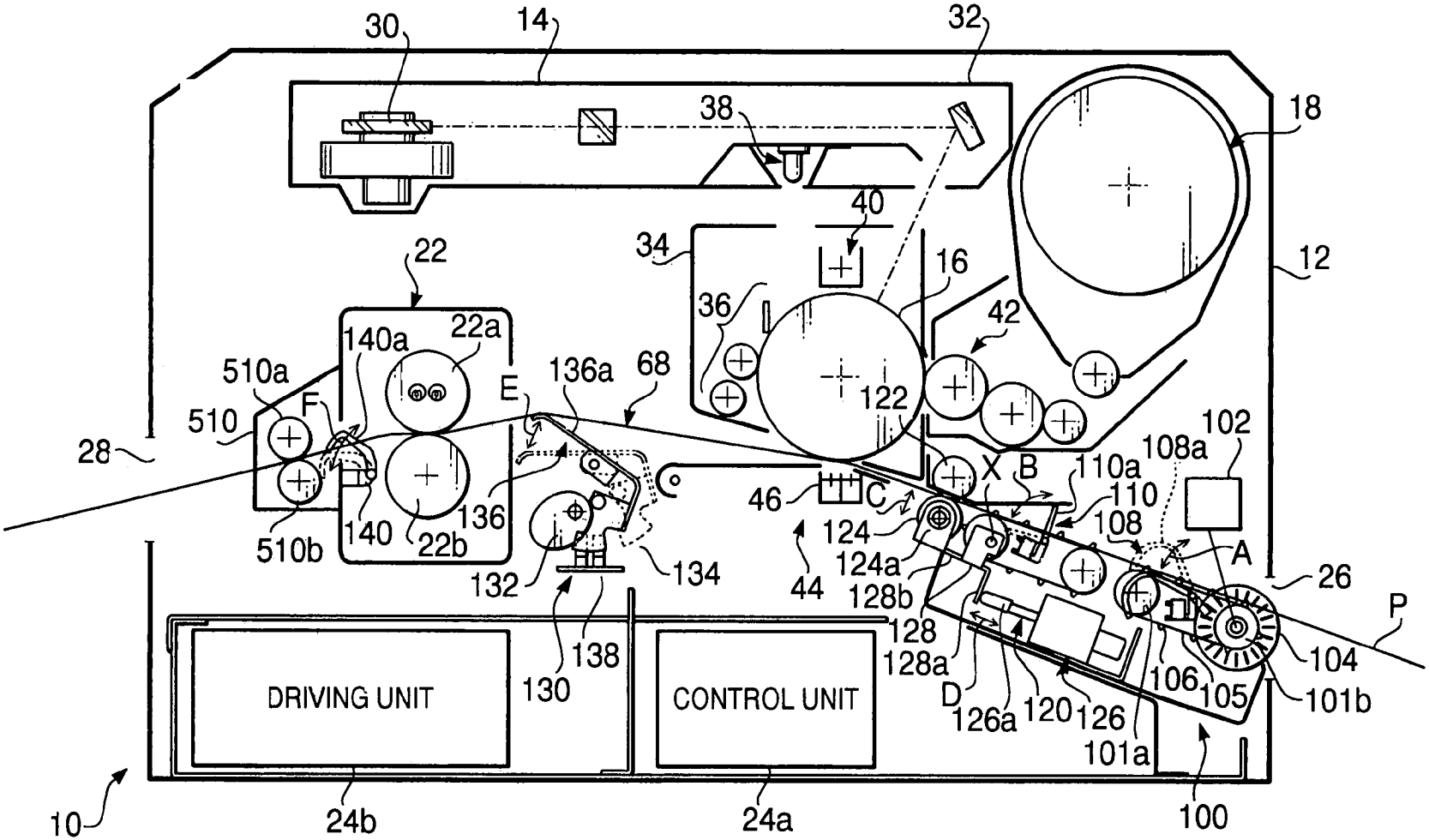
FIG. 1 is a sectional side view of a continuous form printer according to an embodiment of the present invention.

Referring to the drawings, an embodiment according to the present invention will be described hereinafter.

FIG. 1 is a sectional side view schematically showing a structure of a continuous form printer 10 according to the embodiment. The printer 10 is an electrophotographic printer, which prints images and/or characters on continuous form paper P, as fanfold paper, in accordance with the electrophotographic Imaging process using a laser beam. In this embodiment, the images and/or characters to be printed are transferred from an external device such as a computer device in the form of print data.

The continuous form paper P has sprocket holes h (see FIG. 4) at a predetermined pitch on either side, in the width direction, of the paper P. The pitch of the sprocket holes h is ½ inches in this embodiment, however other fanfold paper having different pitch of sprocket holes can be used. Furthermore, the continuous form paper P has separation perforations (not shown), at an interval corresponding to one of several known standard sheet sizes, and individual pages of the continuous form paper P can be separated at the perforations. According to the embodiment, a page length (which is defined a length between subsequent two perforations) of the continuous form paper P is an integral multiple of ½ inches. It is noted that the printer 10 is configured such that continuous form paper having another page length (e.g., an integer multiple of ⅙ inches or ⅛ inches) can be used.

Further, the printer 10 is configured to use normal fanfold paper or label paper having stick-on labels thereon.

As shown in FIG. 1, the printer 10 has a housing 12, a processing unit 18, a laser scanning unit (LSU) 14, a transfer unit 44, a sheet feeding system, a fixing unit 22, a control unit 24*a* and a driving unit 24*b*.

The housing 12 contains/supports various devices, mechanisms and elements therein. The LSU 14 is controlled by the control unit 24*a* to emit a scanning laser beam, which is modulated based on printing information. The processing unit 18 develops the latent image by applying toner to the latent image formed on the drum 16. The transfer unit 44 transfers a toner image from the drum 16 onto the continuous form paper P at a transfer position. The control unit 24*a* controls a print control process and a feeding control process.

The driving unit 24*b* includes a plurality of actuators for driving various mechanisms. All of the actuators are connected with the control unit 24*a*, and the control unit 24*a* controls the actuators.

The driving unit 24*b* is adapted to drive various mechanisms including the photoconductive drum 16, a cleaning roller of a toner cleaning unit 36, a developing roller of a developing unit of the processing unit 18 and other elements.

A paper inlet 26 in which the fanfold paper P is introduced inside the printer 10 is formed on a side surface (i.e., the right-hand side surface in FIG. 1) of the housing 12. A paper outlet 28 from which the fanfold paper is discharged is formed on the opposite side surface (i.e., the left-hand side surface in FIG. 1) of the housing 12.

The LSU 14 includes a unit of devices, which has a laser scanning unit housing 32 in which a polygonal mirror assembly 30 is provided. The processing unit 18 includes a unit of devices, which has a processing unit housing 34 detachably mounted in the housing 12.

In the processing unit housing 34, the photoconductive drum 16 is rotatably supported. Around the photoconductive drum 16, the toner cleaning unit 36 for removing toner remaining on the photoconductive surface of the drum 16, a discharging unit 38 for uniformly removing charges on the whole photoconductive surface of the drum 16, a charging unit 40 for uniformly charging the photoconductive surface of the drum 16, a developing unit 42 for developing a latent image to form a toner image and the transfer unit 44 for transferring the toner image onto the fanfold paper P. The units described above are arranged in the above order around the rotational direction (i.e., in the clockwise direction in FIG. 1). The transfer unit 44 includes a corona charger 46 which is elongated in the axial direction of the drum 16 and extends such that both ends thereof reach both ends of the photoconductive surface of the drum 16, respectively. The corona charger 46 is arranged such that it moves toward and away from the photoconductive drum 16 in the direction perpendicular to the axis of the drum 16. A paper path 68 extending from the inlet 26 to the outlet 28 is exposed when the processing unit housing 34 is removed.

The paper feed system includes plurality of feeding mechanisms which are arranged along the paper path 68 extending from the inlet 26 to the outlet 28.

In the following description, a portion of the paper path 68 on the inlet 26 side will be referred to as an upstream side portion, and a portion of the paper path 68 on the outlet 28 side will be referred to as a downstream side portion.

On the upstream side portion of the paper path 68, a tractor unit 100 capable of feeding the paper P in forward and reverse directions is arranged, in the vicinity of the inlet 26. Being arranged closer to the inlet 26, the tractor unit 100 primarily serves to function as a unit for introducing the paper P in the housing 12.

The tractor unit 100 feeds the paper by means of a rotating endless tractor belt 105 wound on each side of a pair of rollers 101*a* and 101*b*. The tractor unit 100 includes a motor 102 that drives one of the pair of rollers 101*a* and 101*b* of the tractor unit 100, an optical rotary encoder 104 whose output is used to measure the paper feeding speed, a paper empty sensor 108 and an inlet side paper top sensor 110 arranged on the downstream side of the paper empty sensor 108. A plurality of tractor pins 106 are formed on each tractor belt 105, and the tractor pins 106 on each tractor belt 105 are arranged at a predetermined pitch, which is the same as the pitch of the sprocket holes h formed on each side of the fanfold paper P. The tractor pins 106 are inserted in the sprocket holes h, respectively, so that the paper is fed forward or reverse in accordance with the movement of the tractor belts 105.

The paper empty sensor 108 detects absence/presence of the fanfold paper P at a position of the paper empty sensor 108. Similarly, the inlet side paper top sensor 110 detects absence/presence of the fanfold paper P at a position of the inlet side paper top sensor 110. Each of the sensors 108 and 110 is provided with a pivotable lever that is capable of rotating between an upright (first) position and a depressed (second) position. When the lever is at the first position, the lever obstructs the paper path 68. When the lever is located at the second position, the lever is located below the paper path 68.

Specifically, the lever 108*a* of the paper empty sensor 108 is pivotally supported on the tractor unit 100, and is rotatable in the direction of arrow A in FIG. 1. Similarly, the lever 110*a* of the inlet side paper top sensor 110 is pivotably supported on the tractor unit 100, and is rotatable in the direction of arrow B in FIG. 1. The levers 108*a* and 110*a* are urged to be located at the first positions, respectively. When the paper P is not located at the paper empty sensor 108, the lever 108*a* rotates to intersect the paper path 68 as indicated by broken lines. When the paper P is present at the paper empty sensor 108, the lever 108*a* is pressed by the paper P downward and thereby the lever 108*a* stays at the second position. Similarly, when the paper P is absent at the inlet side paper top sensor 110, the lever 110*a* is located at the first position. When the paper P is present at the inlet side paper top sensor 110, the paper P presses the lever 110*a* downward and thereby the lever 110*a* staying at the second position.

When the lever 108*a* of the paper empty sensor 108 is located at the first position, the paper empty sensor 108 sends an ON signal, which represents the absence of the paper P, to the control unit 24*a*. If the lever 108*a* of the paper empty sensor 108 is located at the second position, the paper empty sensor 108 sends an OFF signal to the control unit 24*a*. The OFF signal indicates that the paper P is present at the paper empty sensor 108.

When the lever of the inlet side paper top sensor 110 is located at the first position, the inlet side paper top sensor 110 sends an OFF signal, which indicates that the paper P is absent at the inlet side paper top sensor 11, to the control unit 24*a*. If the lever 110*a* of the inlet side paper top sensor 110 is located at the second position, the inlet-side paper top sensor 110 sends an ON signal to the control unit 24*a*. The ON signal represents that the paper P is present at the inlet side paper top sensor 110. Accordingly, the control unit 24*a* can detect absence/presence of the paper P at the inlet side paper top sensor 110.:

The paper empty sensor 108 is primarily used for detecting the "paper empty" status, and the inlet side paper top sensor 110 is primarily used for detecting that paper P is newly introduced in the printer 10.

On the downstream side of the tractor unit 100, an auxiliary feeding unit 120 is arranged next to the tractor unit 100. The auxiliary feeding unit 120 is used for preventing unsuitable shifting of the paper P, which may occur when the tension on the paper P increases. The auxiliary feeding unit 120 includes a driven roller 122, a driving roller 124, a solenoid 126 and a solenoid arm 128.

The driven roller 122 is arranged such that the rotational axis thereof is secured such that the driven roller 122 contacts the fanfold paper P fed along the paper path 68 and driven as the paper P is fed. The driven roller 122 is formed of material having a relatively low coefficient of friction, such as plastic.

The driving roller 124 is arranged opposed to the driven roller 122 with the paper P nipped between the driven roller 122 and the driving roller 124. The driving roller 124 is driven by the driving unit 24*b* to rotate and feed forward the paper nipped between the rollers. In order to generate an appropriate feeding force, the driving roller 124 is made of material having a relatively high coefficient of friction (which is significantly greater than that of the driven roller 122). The driving roller 124 is supported such that it is moveable, as indicated by arrow C in FIG. 1, between an operable position and a retracted position. When the driving roller 124 is located at the operable position, it is urged to the driven roller 122 with the fanfold paper P nipped therebetween, while when located at the retracted position, the driving roller 124 is spaced from the driven roller 122. Specifically, the driving roller 124 is rotatably mounted on a roller supporting frame 124*a*. The roller supporting frame 124*a* is rotatable about a predetermined axis X.

The solenoid 126 and the solenoid arm 128 move the roller supporting frame 124*a* to rotate. Specifically, the solenoid 126 is controlled by a signal sent from the control unit 24*a* to slide the solenoid shaft 126*a* along an arrow D. The solenoid arm 128 is L-shaped and rotatably supported on the housing 12. The distal end of the solenoid shaft 126*a* contacts a first arm portion 128*a* of the solenoid arm 128. A second arm portion 128*b* is fixed to a roller supporting frame 124*a*, which rotatably supports the driving roller 124. Preferably, the solenoid arm 128 is made of elastic material.

When the solenoid 126 is activated and the solenoid shaft 126*a* slides toward the downstream side (i.e., leftward in FIG. 1) in the direction of the arrow D, the solenoid shaft 126*a* pushes the first arm portion 128*a* of the solenoid arm 128. Then, the solenoid arm 128 is rotated clockwise in FIG. 1 such That the second arm portion 128*b* is lifted upward, thereby moving the driving roller 124 toward the driven roller 122 in the direction of the arrow C. Thus, the driving roller 124 is urged toward the driven roller 122 when the solenoid 126 is activated. In this state, the paper P nipped between the driving roller 124 and the driven roller 122 can be fed when the driving roller 124 is driven.

When the solenoid is deactivated, the solenoid shaft 126*a* slides toward the upstream side (i.e., rightward in FIG. 1) in the direction of the arrow D, the force for pressing the solenoid arm 128 becomes relatively small. Then, by an urging force of a not-shown spring, the solenoid arm 128 is moved away from the driven roller 122 (i.e., counterclockwise in FIG. 1) and brought to the retracted position. Thus, when the solenoid 126 is deactivated, the auxiliary feeding unit 120 does not feed the paper P.

On the downstream side of the auxiliary feeding unit 120, the photoconductive drum 16 and the transfer unit 44 are provided with the paper path 68 being arranged therebetween. At a position between the drum 16 and the transfer unit 44, a toner image is transferred onto the paper P.

On the downstream side of the photoconductive drum 16 and the transfer unit 44, a tension controller 130 which applies predetermined tension to the fanfold paper P is provided. The tension controller 130 includes an eccentric cam 132 driven by the driving unit 24*b* to rotate, a cam follower 134 that contacts the eccentric cam 132, a tension plate 136 for pressing the paper P to provide the paper with tension and a photointerrupter 138 that monitors the position of the tension plate 136. Based on the position of the tension plate 136 detected by the photointerrupter 138, the tension on the paper P is adjusted to be in the suitable range.

The cam follower 134 is rotatably supported on the tension plate 136 and urged toward the rotational axis of eccentric cam 132 by a spring (not shown). The tension plate 136 is rotatably mounted on the housing 12. Accordingly, as the eccentric cam 132 rotates, the cam follower 134 and the tension plate 136 integrally swing and the end portion 136*a* (left-hand side end in the FIG. 1) of the tension plate 136 reciprocates upward and downward in the direction of arrow E.

The width of the tension plate 136 is substantially the same as that of the paper P, and the end portion 136*a* of the tension plate 136 presses the entire width of the paper P. The tension on the paper P increases as the tension plate 136 is driven such that the end portion 136*a* moves toward the paper P (i.e., moves upward). The tension on the paper P decreases as the tension plate 136 is driven in a direction where the end portion 136*a* moves away from the paper P (i.e., moves downward). When the end portion 136*a* of the tension plate 136 moves to a position below a predetermined level (height), the end portion 136*a* is separated from the paper P and the tension plate 136 does not contribute to the control of the tension on the paper P. The tension plate 136 is usually spaced from the paper P when the paper feed system is not feeding the paper P.

The tension plate 136 presses the fanfold paper P with a predetermined pressing force by the cooperation of the eccentric cam 132, the cam follower 134 and the spring (not shown). When the tension on the paper P increases, the tension plate 136 is pressed downward, while when the tension decreases, the tension plate 136 is moved upward. By detecting such movement of the tension plate 136, the control unit 24*a* is capable of detecting the degree of the tension on the paper P.

The photointerrupter 138 is a well-known transparent type photointerrupter, which detects a position of the tension plate 136. The detected position of the tension plate 136 is transmitted to the control unit 24*a*. Then, the control unit 24*a* calculates the degree of the tension applied to the paper P based on the position of the tension plate 136.

The control unit 24*a* controls a difference between the feeding speed of the paper P by the tractor unit 100 and the feeding speed of the paper P by a pair of discharging rollers 510, which are provided on the downstream side of the tension plate 136 and will be described later in detail.

For example, if the detected tension is greater than a predetermined range, the feeding speed of discharging rollers 510 is faster than that of the tractor unit 100 and the paper P is pulled toward downstream side. Therefore, in such a case, the control unit 24*a* decreases the feeding speed of the discharging rollers 510 to decrease the degree of the tension. If the detected tension is smaller than the predetermined range, the feeding speed of the pair of discharging rollers 510 is slower than that of the tractor unit 100. In such a case, the control unit 24*a* increases the feeding speed of the pair of discharging rollers 510 to increase the degree of the tension.

The fixing unit 22 is provided on a downstream side of the tension controller discussed above. The fixing unit 22 includes a heat roller 22*a* and a pressure roller 22*b*. The heat roller 22*a* includes a heat source such as a halogen lamp, which is inserted in a sleeve. The sleeve of the heat roller 22*a* is heated by the heat source. The heat roller 22*a* is provided above the paper path 68.

The pressure roller 22*b* is opposed to the heat roller 22*a* with the paper path 68 therebetween. The pressure roller 22*b* is urged toward the pressure roller with an urging member (not shown) such that the pressure roller 22*b* is press-contacted to the heat roller 22*a*. The toner image transferred to the paper P by the transfer unit 44 is fixed to the paper P when the heat and pressure are applied to the paper P carrying the toner image as the paper P is fed through the nip between the heated heat roller 22*a* and the pressure roller 22*b*.

In order to feed the paper P, the heat roller 22*a* is driven to rotate by the driving unit 24*b*, while the pressure roller 22*b* is adapted to be rotate freely so that it rotates as the paper P is fed.

It should be noted that the pressure roller 22*b* is driven to move upward and downward so that it moves toward and away from the heat roller 22*a*. When the pressure roller 22*b* is spaced from the heat roller 22*a*, the paper P is also separated from the circumferential surface of the heat roller 22*a*, thereby the overheat of the paper P being prevented.

An outlet side paper top sensor 140 is provided on the downstream side of the fixing unit 22. The outlet side paper top sensor 140 is provided with a lever 140*a* that is movable, similarly to the lever 110*a*, between a first position and a second position. When the lever 140*a* is moved to the first position, the lever 140*a* intersects with the paper path 68. When the lever 140*a* is located in the second position, the lever 140*a* does not obstruct the feeding of the paper P.

When the lever 140*a* is located at the first position, the paper top sensor 140 sends an OFF signal representing the absence of the paper P to the control unit 24*a*. If the lever 140*a* is located at the second position, the paper top sensor 140 sends an ON signal indicating the presence of the paper P to the control unit 24*a*. Accordingly, the control unit 24*a* can detect the absence/presence of the paper P at the position of the outlet side paper top sensor 140.

The paper top sensor 140 is primarily used for detecting that the paper P is newly introduced in the printer 10 by detecting the leading end of the fanfold paper P.

Next to the outlet side paper top sensor 140, on the downstream side thereof, the pair of discharging rollers 510 are arranged. The paper P passing through the fixing unit 22 and passing the position of the outlet side paper top sensor 140 is introduced to the pair of discharging rollers 510. The pair of discharging rollers 510 are used for feeding the paper P nipped therebetween to discharge it through the outlet 28 of the housing 12.

The pair of discharging rollers 510 includes a driven discharging roller 510*a* placed above the paper path 68 and a driving discharging roller 510*b* placed below the paper path 68. The rotational axis of the driven discharging roller 510*a* is fixed such that the driven discharging roller 510*a* freely rotates. The driven discharging roller 510*a* is arranged to contact the fanfold paper P, and is driven to rotate as the fanfold paper P moves. The driven discharging roller 510*a* is made of material having a relatively low coefficient of friction, such as plastic.

The driving discharging roller 510*b* is driven by the driving unit 24*b* and primarily feeds the fanfold paper P toward downstream side. For this purpose, the driving discharging roller 510*b* is formed of material having a relatively high coefficient of friction such as rubber (having a significantly higher friction coefficient than the driven discharging roller 510*a*).

Further, the driving discharging roller 510*b* is supported such that it can be located between operable position and retracted position. When located at the operable position, the driving discharging roller 510*b* is urged to the driven discharging roller 510*a*. when located at the retracted position, the driving discharging roller 510*b* is spaced from the driven discharging roller 510*a*.

It should be noted that the feeding speed of the discharging rollers 510*a* and 510*b* is slightly faster than that of the tractor unit 100, and the feeding speed of the auxiliary feeding unit 120 is slightly faster than that of the tractor unit 100 and substantially the same or slightly slower than the that of the discharging rollers 510*a* and 510*b*.

Figure 2:
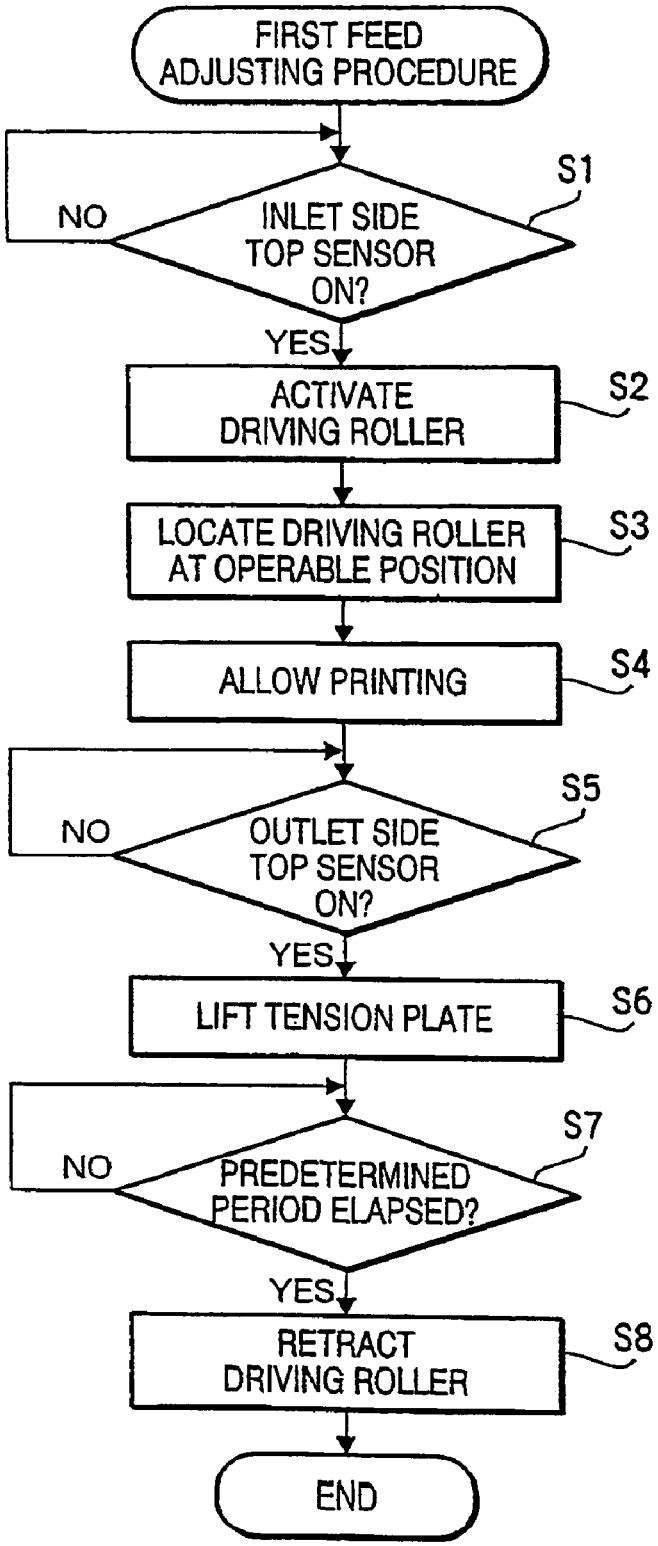
FIG. 2 is a flow chart showing a first adjusting process.

Next, feed adjusting procedures will be described hereinafter. FIG. 2 shows a flowchart illustrating a first feed adjusting procedure according to the embodiment. With the first feed adjusting procedure, a displacement of the paper P that possibly occurs when the fanfold paper P is newly introduced in the printer 10 and the tension controller 130 is activated.

The first feed adjusting procedure shown in FIG. 2 is started when the fanfold paper P is to be newly loaded to the printer 10, and the feeding of the paper P is started.

In S1, the control unit 24*a* monitors the output signal of the inlet side paper top sensor 110. At the initial stage when the paper P is newly introduced, the inlet side paper top sensor 110 is OFF, and control waits (i.e., S1: NO) until the output of the inlet side paper top sensor 110 is changed from OFF to ON. When the output of the inlet side paper top sensor 110 is changed from OFF to ON (S1: YES), the leading end of the fanfold paper P has reached the inlet side paper top sensor 110.

When the control unit 24*a* determines that the new paper P is introduced (S1: YES), process proceeds to S2.

In step S2, the control unit 24*a* controls the driving unit 24*b* to rotate the driving roller 124. The rotational speed of the driving roller 124 is controlled such that the paper feed speed by the feed adjusting unit 120 is slightly faster than that of the tractor unit 100. Thereafter, process proceeds to S3.

In S3, the control unit 24*a* transmits a drive signal to activate the solenoid 126 so that the solenoid shaft 126*a* slides toward the downstream side in the direction of arrow D. Then, the second arm portion 128*b* moves the driving roller 124 in the direction of arrow C, thereby the paper P being nipped between the driving roller 124 and the driven roller 122 and a predetermined pressing force is applied from the driving roller 124 to the driven roller 122. Immediately after the paper P is nipped between the driving roller 124 and the driven roller 122, the paper P is fed faster than the feeding speed of the tractor unit 100. With this control, the relationship between the sprocket holes h and the tractor pins 106 is changed from a condition shown in FIG. 4B to that shown in FIG. 4C, which will be described in detail later.

After S3 is executed, process allows that the printing operation (including the image transfer from the photoconductive drum to the paper P) is executed (S4). Then, in step S5, process monitors whether the leading end of the fanfold paper P reaches the outlet side top sensor 140.

Until the output of the outlet side top sensor 140 is OFF (S5: NO), process repeats S5. When the leading end of the paper P has reached and the output of the outlet side top sensor 140 has changed from OFF to ON (S5: YES), process proceeds to S6.

In step S6, the control unit 24*a* controls the driving unit 24*b* to rotate the eccentric cam 132 such that the tension plate 136 moves up and applies the tension to the paper P. That is, the end portion 136*a* of the tension plate 136 presses the paper P and tension on the paper P increases. It should be noted that the fanfold paper P is nipped between the driven discharging roller 510*a* and the driving discharging roller 510*b* before a tension on the paper P arises since the outlet side paper top sensor 140 is located on the downstream side of the discharging rollers 510. Then process proceeds to S7.

In S7, process waits for a predetermined period during which the tension applied by the tension plate 136 to the fanfold paper P increases and becomes a predetermined value. If the predetermined time has not passed after the paper P reached the outlet side paper top sensor 140 (S7: NO), S7 is repeated. If the predetermined period has passed (S7: YES), the controller 24 executes S8.

In step S8, the control unit 24*a* controls the driving unit 24*b* to deactivate the solenoid 126. At this stage, the solenoid shaft 126*a* slides toward the upstream side in the direction of arrow D. Then, the driving roller 124 is retracted (i.e., moves in the direction of arrow C). Thus, the first feed adjusting procedure is finished.

Figure 4A:
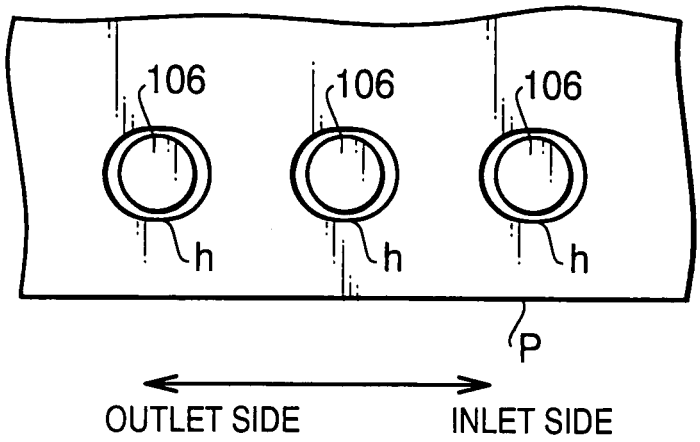
FIGS. 4A-4C are enlarged plan views showing a relationship between sprocket holes of the continuous form paper and pins of a tractor.
Figure 4B:
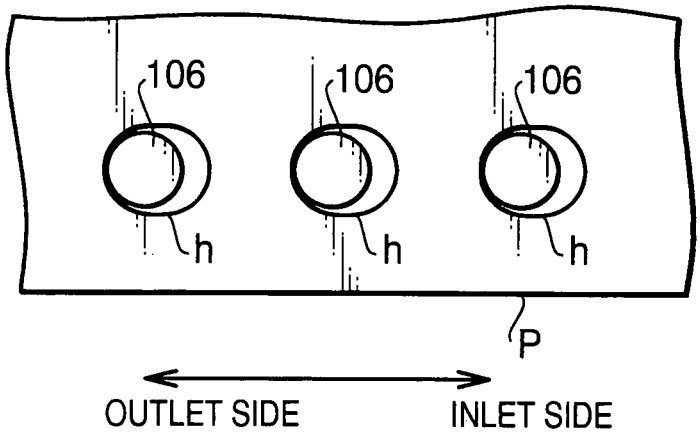
Figure 4C:
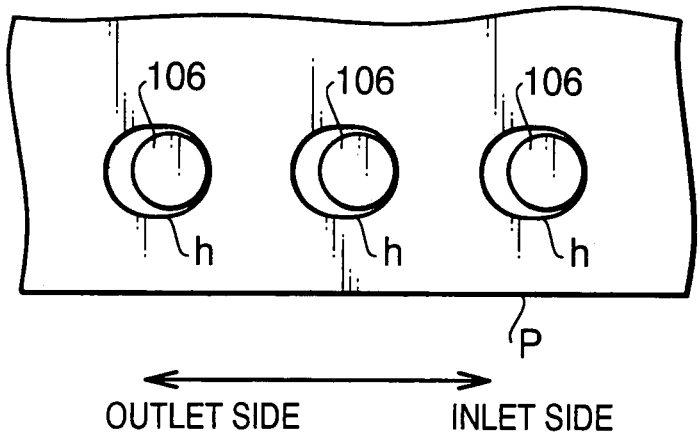

Referring now to FIGS. 4A-4C, a cause of the displacement of the paper P which occurs when the fanfold paper P is newly introduced and the principle for preventing the defects due to the displacement will be described.

FIGS. 4A-4C show enlarged plan views each showing a positional relationship of the sprocket holes h of the fanfold paper P and tractor pins 106 of the tractor unit 100.

FIG. 4A illustrates a positional relationship between the sprocket holes h and the tractor pins 106 before the paper P is fed. As shown in FIG. 4A, the diameter of a sprocket hole h is slightly larger than that of the tractor pin 106 so that the tractor pins 106 can be inserted in the sprocket holes h easily. A clearance is formed between the inner edge of each sprocket hole h and the circumferential surface of the tractor pin 106 inserted in the sprocket hole h.

FIG. 4B shows a positional relationship between the sprocket holes h and the tractor pins 106 when the tractor unit 100 starts feeding the paper P, but neither the tension controller nor the auxiliary feeding unit 120 is activated. At this stage, since the tractor unit 100 feeds the paper P with the tractor pins 106 which pushes the downstream edges of the sprocket holes h, respectively, the clearance is formed only between the upstream side edge of each sprocket hole h and the upstream side surface of the tractor pin 106.

If the auxiliary feeding unit 120 is not provided in the printer 10, and the tension controller is activated, the paper P would move toward the portion at which the tension plate 136 pushes the paper P. Since the paper P is nipped between the heat roller 22*a* and pressure roller 22*b*, and a pair of discharging rollers 510*a* and 510*b*, as the tension on the paper P increases, the upstream side portion of the paper P is pulled toward the tension plate 136. Since there is a clearance between the upstream side surface of each tractor pin 106 and the upstream side edge of each sprocket hole h, the paper P can be shifted with respect to the tractor unit 100 by the amount of the clearance.

As a result of this movement of the paper P with respect to the tractor unit 100, the clearance is formed on the downstream side of each hole h as shown in FIG. 4C. That is, condition shown in FIG. 4B is changed to that shown in FIG. 4C as the tension controller 130 operates. Since the tension controller 130 is activated after the transfer of the toner image starts, the position at which the toner image is transferred onto the paper P is shifted in the paper feeding direction after the tension controller 130 is activated. If such shifting of image occurs, the quality of the image is deteriorated.

The auxiliary feeding unit 120 operates such that the paper P is fed in a condition shown in FIG. 4C before image transfer operation is started. In other words, the image transfer operation is allowed after the positional relationship between the paper P and the tractor unit 100 is set to the condition shown in FIG. 4C.

Referring to the flowchart shown in FIG. 3, the second feed adjusting procedure will be described. The second feed adjusting procedure is for preventing a problem that occurs when an image is transferred onto the last page (segment) of the fanfold paper P, which is to be discharged.

The second feed adjusting procedure periodically monitors the ON/OFF status of the paper empty sensor 108, and the auxiliary feeding unit 120 is actuated when the paper empty is detected.

Figure 3:
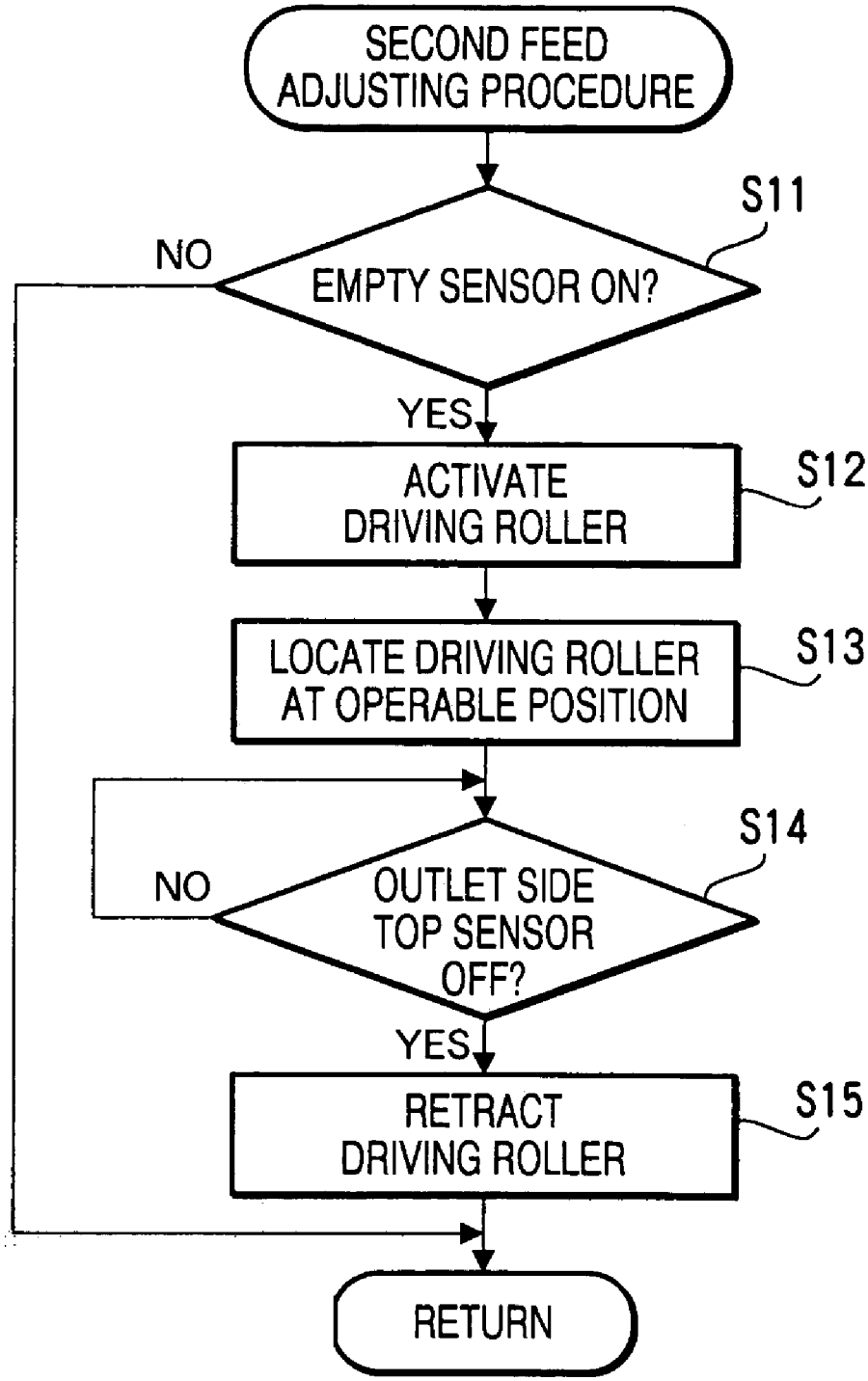
FIG. 3 is a flow chart showing a second adjusting process.

In S11 of FIG. 3, the control unit 24*a* judges whether a signal transferred from the paper empty sensor 108 represents the ON status. When the signal represents the OFF status (i.e., the paper P is not absent at the paper empty sensor 108), control skips the other steps and the procedure is finished.

If the status of the paper empty sensor 108 is changed from OFF status to ON status (S11: YES), control proceeds to S12, where the driving roller 124 is driven to rotate to have the circumferential speed same as the feeding speed of the paper P. Then, in S13, the solenoid 126 is activated so that the driving roller 124 is urged toward the driven roller 122 with the paper P, which is being fed, nipped therebetween.

In step S14, the control unit 24*a* judges whether the trailing end of the fanfold paper P has passed the position of the outlet side paper top sensor 140.

Before the trailing end of the paper P reaches the outlet side paper top sensor 140 (S14: NO), step S14 is repeated. If the trailing end of the paper P has passed the position of the outlet side paper top sensor 140 (S14: YES), the control unit 24*a* deactivate the solenoid 126 to retract the driving roller 124.

By employing the second feed adjusting procedure, the paper P is fed by both of the tractor unit 100 and the auxiliary feeding unit 120 while the tractor pins 106 engage with the sprocket holes h of the paper P. After the trailing end of the paper P has passed the tractor unit 100 (i.e., when there is no engagement between the tractor unit 100 and the paper P) the auxiliary feeding unit 120, which is arranged in the vicinity of the transfer unit 44, still engages with the paper P to hold and feed the paper P. Therefore, the toner image can be transferred on the paper appropriately on the last page of the fanfold paper P.

If the auxiliary feeding unit 120 where not provided, the paper P would displaced significantly as soon as the engagement between the tractor unit 100 and the paper P is released, and the toner image could not be transferred appropriately on the last page of the fanfold paper P.

It should be noted that the present invention is not to limited to the above-described embodiment. Various modifications can be made without departing from the scope of the invention.

The present disclosure relates to the subject matter contained in Japanese Patent Application No. 2003-414603, filed on Dec. 12, 2003, which is expressly incorporated herein by reference in its entirely.

What is claimed is:

1. A paper feeding mechanism for a printer in which an image is transferred, at an image transfer station, onto continuous form paper which is fed along a paper feed path defined in the printer, the paper feeding mechanism comprising:

a discharging unit located on a downstream side of the paper feed path, the discharging unit feeding the continuous form paper to discharge from the printer;

a feeding unit located on an upstream side with respect to the image transfer station, the feeding unit feeding the continuous form paper toward the image transfer station;

a tension applying unit that operates to apply tension to the continuous form paper at a position between the image transfer station and the discharging unit; and a displacement preventing system that prevents a displacement of the continuous form paper in a feeding direction of the continuous form paper when the tension applying unit operates to apply the tension to the continuous form paper, wherein the displacement preventing system is configured to shift the continuous form paper in a downstream direction prior to operation of the tension applying unit.

2. The paper feeding mechanism according to claim 1, further includes an outlet side paper sensor arranged in the vicinity of the discharging unit, the outlet side paper sensor detecting whether the continuous form paper is present at a position of the outlet side paper sensor, wherein the tension applying unit is activated after the outlet side paper sensor detects that the continuous form paper is present.

3. The paper feeding mechanism according to claim 2, wherein the displacement preventing system is deactivated after the tension applying unit applies the tension to the continuous form paper.

4. The paper feeding mechanism according to claim 1, wherein the displacement preventing system feeds the continuous form paper at a speed faster than the feeding speed of the feeding unit.

5. The paper feeding mechanism according to claim 1, wherein the displacement preventing system is located at a position between the feeding unit and the tension applying unit.

6. The paper feeding mechanism according to claim 1, wherein the displacement preventing system includes:

a pair of rollers; and a driving system that drives the pair of rollers to rotate.

7. The paper feeding mechanism according to claim 6, wherein the pair of rollers includes a driving roller that is actuated to rotate and a driven roller that is freely rotatably supported, a circumferential surface of the driving roller having a higher frictional coefficient than that of the driven roller.

8. The paper feeding mechanism according to claim 1, further comprising an inlet side paper sensor located on an upstream side of the displacement preventing system, the inlet side paper sensor detecting whether the paper is present at a position where the inlet side paper sensor is located, the displacement preventing system being activated when the inlet side paper sensor detects presence of the continuous form paper.

9. The paper feeding mechanism according to claim 8, wherein the image is transferred after the displacement preventing system is activated.

10. The paper feeding mechanism according to claim 9, further including an outlet side paper sensor arranged in the vicinity of the discharging unit, the outlet side paper sensor detecting whether the continuous form paper is present at a position of the outlet side paper sensor, the displacement preventing system being deactivated at a predetermined period after the outlet side paper sensor detects the presence of the continuous form paper.

11. The paper feeding mechanism according to claim 1, further includes a trailing end sensor that detects the trailing end of the continuous form paper, the trailing end sensor being arranged on an upstream side of the feeding unit, the displacement preventing system being activated when the trailing end sensor detects the trailing end of the continuous form paper.

12. The paper feeding mechanism according to claim 11, further including an outlet side paper sensor arranged in the vicinity of the discharging unit, the outlet side paper sensor detecting whether the continuous form paper is present at a position of the outlet side paper sensor, the displacement preventing system being deactivated when the outlet side paper sensor detects absence of the continuous form paper after the trailing end sensor detects the trailing end of the continuous form paper.

13. The paper feeding mechanism according to claim 1, wherein the feeding unit includes a tractor unit having a pair of tractor belts each provided with a plurality of tractor pins, the continuous form paper being formed with a plurality of sprocket holes with which the plurality of tractor pins engage, respectively.

14. The paper feeding mechanism according to claim 13, wherein each sprocket hole is elongated in the feeding direction of the continuous form paper, a clearance being formed between a surface of each tractor pin and an upstream side edge of a corresponding sprocket hole when the continuous form paper is fed by the feeding unit and the displacement preventing system is deactivated, a clearance being formed between the surface of each tractor pin and a downstream side edge of a corresponding sprocket hole when the continuous form paper is fed by the displacement preventing system.

15. An electrophotographic printer that forms an image on continuous form paper in accordance with an electrophotographic imaging method, the printer comprising:

a scanning unit that emits a scanning beam which is modulated in accordance with print information;

a photoconductive drum which is exposed to the scanning beam, a latent image being formed on the photoconductive drum as scanned by the scanning beam;

a developing unit that develops the latent image by applying toner to the latent image to form a toner image;

a transfer unit that transfers the toner image on the continuous form paper which is fed along a paper feed path defined in the printer;

a fixing unit that fixes the toner image transferred onto the continuous form paper;

a discharging unit located on a downstream side of the paper feed path, the discharging unit feeding the continuous form paper to discharge from the printer;

a feeding unit located on an upstream side with respect to the transfer unit, the feeding unit feeding the continuous form paper toward the transfer unit;

a tension applying unit that operates to apply tension to the continuous form paper at a position between the transfer unit and the discharging unit; and a displacement preventing system that prevents a displacement of the continuous form paper in a feeding direction of the continuous form paper when the tension applying unit operates to apply the tension to the continuous form paper, wherein the displacement preventing system is configured to shift the continuous form paper in a downstream direction prior to operation of the tension applying unit.

16. A method of feeding continuous form paper in a printer in which an image is transferred, at an image transfer station, onto continuous form paper which is fed along a paper feed path defined in the printer, the printer including a discharging unit located on a downstream side of the paper feed path, the discharging unit feeding the continuous form paper to discharge from the printer, a feeding unit located on an upstream side with respect to the image transfer station, the feeding unit feeding the continuous form paper toward the image transfer station, a tension applying unit that operates to apply tension to the continuous form paper at a position between the image transfer station and the discharging unit, an auxiliary feeding unit located between the feeding unit and the transfer station, the method comprising:

detecting a leading end of the continuous form paper at a position on the upstream side of the auxiliary feeding unit;

activating the auxiliary feeding unit to feed the continuous paper at a speed higher than the feeding speed of the feeding unit;

allowing the image transfer onto the continuous form paper;

detecting the leading end of the continuous form paper at a position in the vicinity of the discharging unit;

activating the tension applying unit to apply tension to the continuous form paper; and deactivating the auxiliary feeding unit after the tension applying unit has been activated to apply the tension to the continuous form paper.

17. The paper feeding mechanism according to claim 1, wherein the feeding unit comprises a tractor unit having at least one tractor belt provided with a plurality of tractor pins, the plurality of tractor pins being configured to engage a plurality of sprocket holes formed on the continuous form paper; and wherein the displacement preventing system comprises a pair of rollers located on a downstream side of the tractor unit, and a driving system that drives the pair of rollers to rotate, the pair of rollers rotating at a speed such that the continuous form paper is fed at a speed which is faster than a continuous form paper feed speed of the tractor unit when the plurality of tractor pins engage the plurality of sprocket holes formed on the continuous form paper.

18. The printer according to claim 15, wherein the feeding unit comprises a tractor unit having at least one tractor belt provided with a plurality of tractor pins, the plurality of tractor pins being configured to engage a plurality of sprocket holes formed on the continuous form paper; and wherein the displacement preventing system comprises a pair of rollers located on a downstream side of the tractor unit, and a driving system that drives the pair of rollers to rotate, the pair of rollers rotating at a speed such that the continuous form paper is fed at a speed which is faster than a continuous form paper feed speed of the tractor unit when the plurality of tractor pins engage the plurality of sprocket holes formed on the continuous form paper.

* * * * *